United States Patent [19]

Fastenau

[11] Patent Number: 4,637,586

[45] Date of Patent: Jan. 20, 1987

[54] FORM FOR PRODUCING CONCRETE RAILS

[75] Inventor: Werner Fastenau, Esslingen-Rüdern, Fed. Rep. of Germany

[73] Assignee: Ed. Züblin Aktiengesellschaft, Stuttgart-Möhringen, Fed. Rep. of Germany

[21] Appl. No.: 806,261

[22] Filed: Dec. 6, 1985

[30] Foreign Application Priority Data

Dec. 8, 1984 [DE] Fed. Rep. of Germany ..... 3444896

[51] Int. Cl.[4] ..... B28B 7/04

[52] U.S. Cl. ..... 249/159; 249/2

[58] Field of Search ..... 249/155, 159; 404/106, 404/105

[56] References Cited

U.S. PATENT DOCUMENTS

| | | | |
|---|---|---|---|
| 877,870 | 1/1908 | Shone et al. | 249/8 |
| 1,644,586 | 10/1927 | Heltzel | 249/5 |
| 3,157,098 | 11/1964 | Mason | 249/5 |

*Primary Examiner*—Bernard Nozick

*Attorney, Agent, or Firm*—Becker & Becker, Inc.

[57] ABSTRACT

The invention relates to a form for producing concrete rails for rubber-tired vehicles which are guided on a track. In contrast to steel rails, concrete rails no longer bend after production, so that numerous different molds are required for curves, transition curves, super elevations, and the like. This drawback is avoided with the form according to the invention, wherein the form makes it possible to produce both straight rail sections, as well as rail sections having varying curvatures, using the same mold. As a result, the expenditure for rail forms is considerably reduced.

6 Claims, 3 Drawing Figures

FORM FOR PRODUCING CONCRETE RAILS

The invention relates to shuttering or forms for producing concrete rails with a horizontal tread and a vertical guide portion for track-guided, rubber-tired vehicles.

BACKGROUND OF THE INVENTION

Rails of this type consist essentially of a horizontal tread and a vertical guide portion. This type of rail has the same purpose as railway rails and is intended to provide both a comfortable and a flat tread which is rated for the loads of the moving vehicles, and lateral guidance for the vehicle traveling thereon.

Concrete rails, in particular, are suitable for track-guided rubber-tired vehicles for reasons of cost and with regard to the reliable frictional resistance or contact between wheel and tread or driving surface. Concrete rails of this type must be able to be produced economically in large numbers and, in this case, must fulfill very high requirements with regard to quality and dimensional accuracy. They are therefore pre-manufactured at the factory as finished concrete parts using very exact shuttering or forms. Whereas the railway rails consisting of steel can be adapted to the shape of the line by bending at the site, bending of concrete rails, especially about the vertical axis, is not possible, since the moment of resistance about this axis is very great. Moreover the friability of the building material does not allow bending in this dimension.

Initial attempts to follow curved lines with straight rails laid polygonally have proved useless in practice, since even with large radii, the periodically recurring breaks in the guide web or portion very quickly lead to a dynamic build-up of steering or guiding movements, which considerably impairs the traveling comfort and safety.

For this reason there has been a change towards producing concrete rails with curved guide portions. This is very expensive, since, for example, with a curve designed with two tracks (two rails per track), segments with four different radii have to be produced. As this example shows, numerous curves with different radii and, therefore, also a plurality of various forms for producing the corresponding concrete rail segments is required for normal rail guidance. The plurality of shutterings or forms required is further increased due to the fact that, at the beginning of the curve and at the end of the curve, transition bends and banking turns also have to be constructed.

It is therefore an object of the invention to construct a form for producing rails of the aforementioned type, so that both straight concrete rails, as well as concrete rails of varying curvature, can be produced by means of the same form.

BRIEF DESCRIPTION OF THE DRAWINGS

This object, and other objects and advantages of the present invention, will appear more clearly from the following specification in conjunction with the accompanying drawings, in which.

SUMMARY OF THE INVENTION

Figure 2:
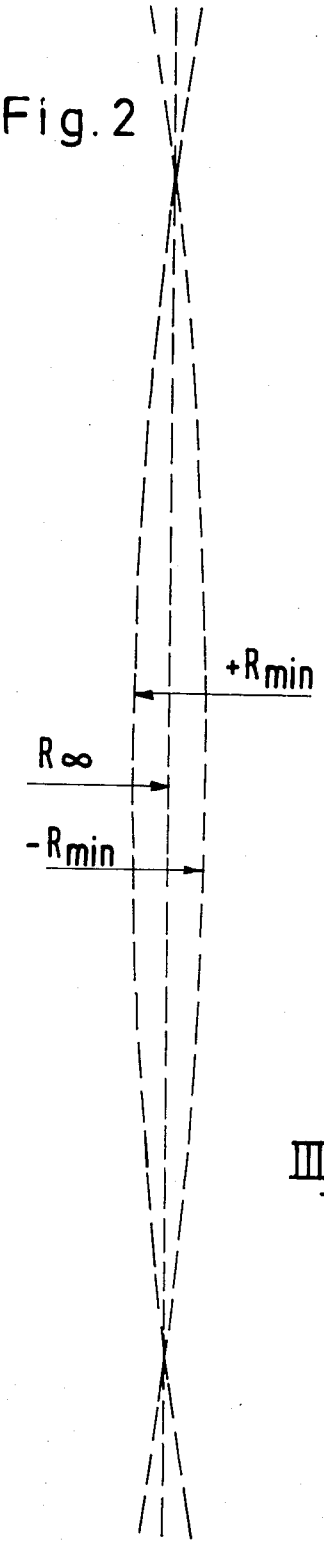
FIG. 2 is a diagrammatic illustration of the adjustability of the form about a vertical axis, with $\pm R$ representing the smallest adjustable radii between the straight lines $R\infty$.

The present invention is characterized primarily in that the guide surface shuttering or form, which is continuous over the entire length of the form, can be curved by means of elastic bending. The guide surface form is provided with supports to which it is attached. These supports are also adjustably attached to a rigid frame. The curvature of the guide surface form can be adjusted by shifting these supports. Also provided is a tread form which consists of plate-like members that are arranged at a distance apart from one another and in the longitudinal direction of the form for adaptation to a desired curvature. The tops of the plate-like members are covered with a resilient covering for bridging the gaps which are formed between them, and for forming a flat shuttering or sheathing surface.

With the form according to the present invention, both straight and curved concrete rails can be produced, with the radius of curvature being adjustable as desired. The concrete rails produced in the inventive form have a flat tread and an equally flat seam-free surface on the adjoining guide portion. The smooth surface of the guide portion is achieved by the continuous guide surface shuttering or sheathing, which may be curved by bending. The flatness of the tread is achieved by means of the resilient covering, which covers the gaps formed between the individual plates of the tread form. The gaps between the plates of the tread form are necessary in order to allow the tread form to follow the bend of the guide surface shuttering or form.

One embodiment of the form according to the present invention, in which the supports are arranged at right angles to the guide surface shuttering or form and in a row along the form, is particularly advantageous and allows exact adjustment of the desired radii of curvature. In addition, providing the plate-like members of the inventive form with strengthening supports improves the stability of the form and can be achieved with low construction costs.

Further, the resilient covering is advantageously constructed of rubber and as a continuous sheet extending over the entire length of the form. The resilient covering is also provided with a surface structure. These features allow corresponding profiling or shaping of the subsequent tread to be achieved by the profiling or shaping of the covering surface. As a result, the tread of the rail can be shaped in such a way that, for example, the required frictional contact is increased and the traveling noises are reduced.

In addition, the tread form may be provided with supports which are arranged approximately at right angles to the guide portion form, and which may be inclined with respect to each other and with respect to the horizontal. This construction facilitates the curvature of the concrete rails not only about a vertical axis, but, in addition, also about a horizontal axis. As a result, it is possible to provide the tread of the rails with banking. Such a construction is advantageous, for example, at the beginning or at the end of a curve. With this construction of the shuttering it is also possible to produce concrete rails having end cross sections which are rotatable about an angle. Twisting of the concrete rails through such an angle would no longer be possible after hardening of the concrete because of the high torsional rigidity.

A particular advantage achieved by use of the inventive form is that concrete rails having any curvature for a line shape can be produced. This means, on the one hand, a considerable saving of expenditure, and, on the other hand, simplification in planning, because one is not forced to make a compromise by selecting a low number of different rail components in order to obtain acceptable form costs.

In addition, the inventive form can be produced with a low expenditure and the simplest production means, while the task of adjusting the desired angle of curvature and/or inclination can be carried out quickly and simply.

DESCRIPTION OF THE PREFERRED EMBODIMENT

Figure 1:
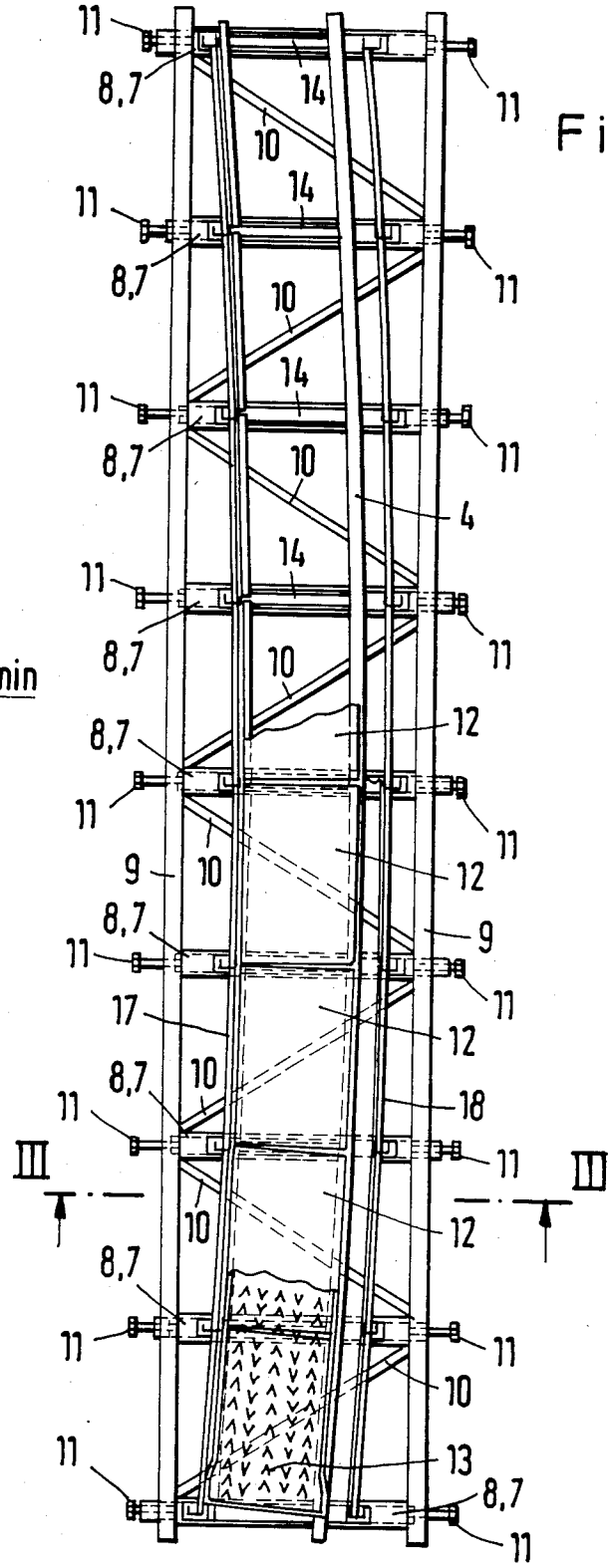
FIG. 1 is a plan view of a form according to the present invention, with the shuttering plates in the upper half not being shown for the sake of greater clarity.
Figure 3:
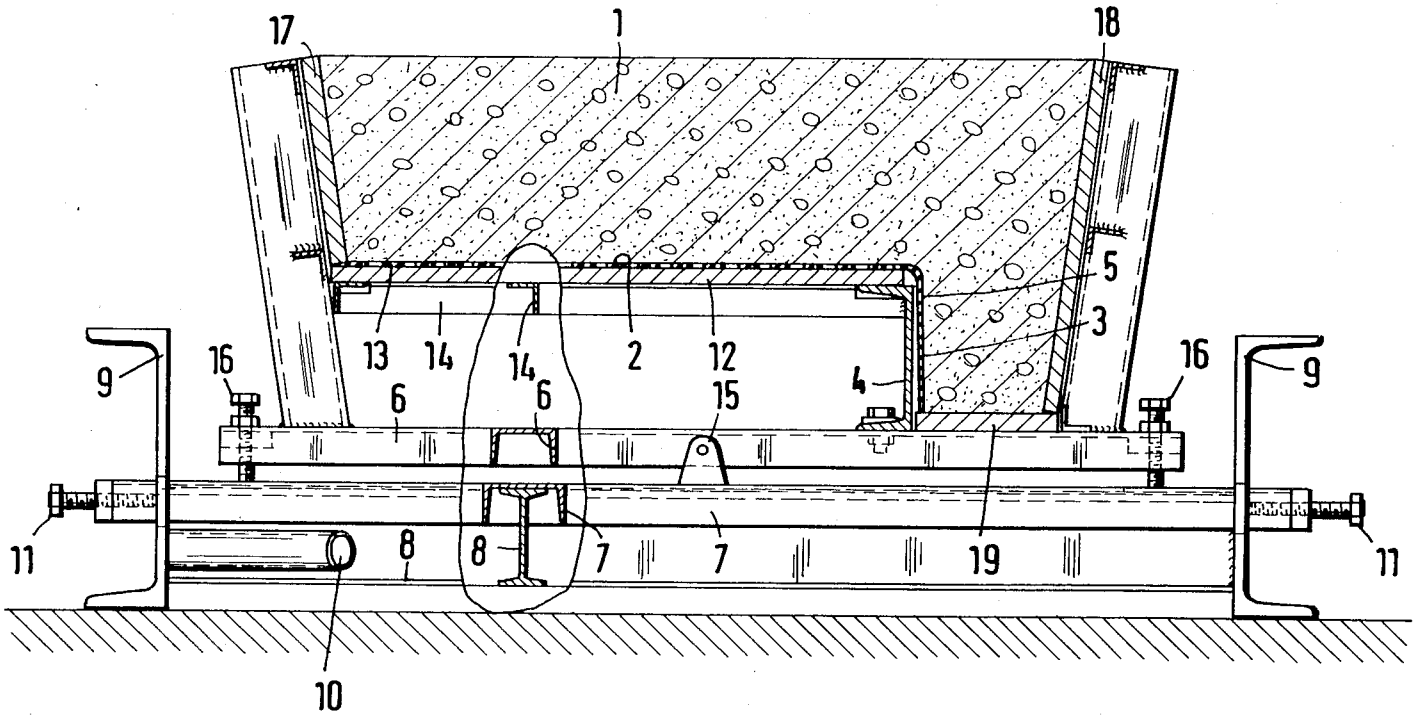
FIG. 3 is a section taken along the line III—III of FIG. 1 and showing the transverse profiles or sections used and further showing the form filled with concrete.

Referring now to the drawings in detail, the form illustrated in FIG. 1 is set up for producing a curved rail section and is not yet filled with concrete. The end shuttering or sheathing which is required at the top ends of the form is also missing. The sectional illustration according to FIG. 3 shows the form filled with concrete and the section of the concrete rail 1 produced therein. The concrete rail 1 consists of a horizontal tread 2 and a vertical or lateral guide portion 3. For manufacturing purposes, the rail is shown in an upside down position; in subsequent operation the tread 2 points upwards. Apart from the flatness of the tread, the most important requirement made of the concrete rail is that the guide portion 3 follows very accurately a pre-determined line which may be a curve or a straight line. The guide portion 3 of the concrete rail is formed by the profile or section 4 which extends along the entire form length, and on which further planking 5 is located for achieving a better surface and for better forming-out, especially of the corners. The planking 5 is not absolutely necessary, but is very advisable. The section 4, which is illustrated in this embodiment, is a U-shape, with the height of the sides corresponding approximately to half the width of the cross member. According to the dimensions of the form or of the rail to be formed, the section 4 can be chosen so that it is elastically deformable in the range $\pm R_{min}$ (see FIG. 2). The section 4 is able to move within certain limits; for example, it is attached by screws to the supports 6 which extend perpendicularly thereto, and which in this embodiment likewise have a U-shape (FIG. 3). The supports 6 are seated on supports 7, which are supported to move transversely on supports 8. In this embodiment, the supports 7 likewise have a U-shaped cross section, wherein the ends of the sides of the section point downwards and surround the upper part of a double T-shape of the support 8. As shown in FIG. 3, the inner side of the crosspiece of the support 7 lies on the upper side of a double T-shaped support 8, so that the sides of the U-shaped support 7 form a guide and prevent any movement in the longitudinal direction of the form or sheathing. The supports 7 may thus be moved transversely on the supports 8. The supports 8 are very resistant to bending and form the transverse ribbing of a rigid frame, wherein the longitudinal ribs are formed by the belts 9, which extend in the longitudinal direction over the entire length of the form. For strengthening and reinforcement, the frame consisting of longitudinal ribs 9 and transverse ribs or supports 8 is provided at the factory with diagonal struts 10, which extend respectively between the belts 9 close to the remote ends of adjacent transverse supports 8. In this embodiment, the diagonal struts 10 are tubular, but other suitable profiles or shapes may also be used. The frame 8, 9, 10 of the form is attached to a foundation, for example, a concrete floor, as illustrated diagrammatically in FIG. 3. The supports 7, which slide on the supports 8, are guided through corresponding openings in the portions of the belts 9 and can be supported against the portions of the belts 9 or the ends of the supports 8 by means of spindles 11. By a corresponding adjustment of the spindles 11, any elastic curvature about a vertical axis can be imparted to the section 4, as shown by way of example in FIG. 1. This curvature is then locked by the spindles 9, so that automatic shifting is precluded and the curvature is fixed. In the illustrated embodiment, the tread form consists of individual rectangular shuttering plates or sheathing panels 12 which may be made, for example, of wood, and which are covered with a rubber-type covering 13. In this embodiment, the individual shuttering plates are of wood and measure 1 meter by 1½ meters, with the thickness of the material being between 15 and 25 mm. In this embodiment, eight shuttering plates 12 are arranged one behind the other and are separated by a small interval, with the total length of the shuttering amounting to approximately 12.5 meters. The intervals between the shuttering plates 12 are necessary in order that the latter can follow the curvature of the section 4. The shuttering plates 12 are provided at intervals with strengthening supports 14, which in this embodiment comprise L-shapes. The shuttering plates 12 may be laid loosely on the supports 14 and are arranged in rows in the longitudinal direction of the form so that they are adapted to the curvature of the section 4, i.e. to the desired curvature of the concrete rail 1, by means of slight mutual shifting and/or rotation.

The slot- or gusset-like intervals existing between the shuttering plates 12 and the longitudinal edges are bridged with a resilient covering 13, for example, of rubber, which is chosen to be so rigid that the gaps in the concrete are not apparent. The covering 13 must be deformable enough that it still remains flat even in the case of the greatest curvature ($\pm R_{min}$). In this embodiment the resilient covering 13 is a soft rubber sheet having a thickness of approximately 7 mm, which extends over the entire length of the form. According to the invention the covering 13 is provided with a structured surface, as shown in the lower half of FIG. 1. The surface structuring of the covering 13 allows a corresponding structuring of the tread 2 of the subsequent concrete rail 1. As a result of corresponding structuring of the surface, the frictional contact between the wheel and tread 2, as well as the traveling noises on the rail 1, can be positively influenced.

In order to be able to produce super elevations in the curves, one requires concrete rails wherein the end cross sections are turned through an angle with respect to each other. In order to be able to produce concrete rails of this type in the form according to the invention, the supports 6 are connected to the supports 7 by way of joints 15. Consequently, the supports 6 are mounted like a balance beam on the supports 7. The inclination of the supports 6 with respect to the supports 7 can be adjusted by means of two screw spindles 16 at the ends of the supports 6. The supports 6, and thus also the tread form, can thereby be inclined slightly with respect to the horizontal transversely with respect to the longitudinal axis of the form. The adjusting spindles 16 are constructed to be self-locking, so that automatic adjustment is effectively prevented.

The form also comprises lateral shutterings or sheathings 17, 18 and horizontal shuttering or sheathing 19 for the upper side of the guide portion (FIG. 3). Since in the production of the concrete rail 1, it is solely a question of the tread 2 and lateral surfaces 3 of the guide portion exactly following the curve of the guide form, the shutterings 17, 18 and 19 do not need to be adapted exactly to the pre-set curvature. With the exception of the shuttering 19, these shutterings may even extend straight over the entire length of the form. Because of their low moments of resistance, in the case of small curvatures, the lateral shutterings 17 and 18 may bend elastically in this direction. Even the horizontal shuttering or sheathing 19 can be adapted to the curvature 4 when a suitable material, for example wood, is used. However, the sheathing may also consist of individual members, which follow the curvature polygonally. In this case also a resilient covering may possibly be provided. While the surface quality is not important, this covering must ensure the tightness of the shuttering. Also, the lateral shutterings 17 and 18 may consist of individual components placed one after the other in the longitudinal direction of the shuttering, since in this case it is likewise not a question of the surface structure but only the tightness of the shuttering.

The present invention is, of course, in no way restricted to the specific disclosure of the specification and drawings, but also encompasses any modifications within the scope of the appended claims.

What I claim is:

1. A form for producing concrete rails having a horizontal tread and a vertical guide portion for track-guided, rubber-tired vehicles, said form comprising:

a frame which is provided with a first side;

at least one first support and at least one second support, with said second support being adjustably connected to said first side of said frame;

a sheathing having a first end and a second end;

a first lateral sheathing having a first end which is connected to said second end of said sheathing;

a second lateral sheathing having a first end which is connected to a second end of plate members;

a guide portion sheathing which is provided with a first end and a second end, with said second end being positioned at substantially right angles to said first end of said first lateral sheathing and being connected to said first support, and with said guide portion sheathing being continuous and extending along the entire length of said form, and with said guide portion sheathing being capable of being adjustably curved by shifting of said first and said second supports; and a tread sheathing which is provided with said plate members and a resilient covering, with said plate members being separated from one another by a gap and with said plate members being arranged adjacent one another following the longitudinal direction of said form, and with said plate members being provided with a side remote from said first support, wherein said last-mentioned sides of said plate members are connected by said covering which thereby bridges said gaps and forms a flat shuttering surface, and with a first end of one of said plate members being connected to said first end of said guide portion sheathing forming substantially at right angle therewith.

2. A form according to claim 1, wherein said first and said second supports are arranged in a row and are positioned at right angles to said guide portion sheathing.

3. A form according to claim 1, wherein said plate members are provided with strengthening supports.

4. A form according to claim 1, in which said covering is made of rubber and is constructed as one continuous sheet which extends along the entire length of said form.

5. A form according to claim 1, in which said covering is provided with a surface structure.

6. A form according to claim 3, in which said strengthening supports are arranged approximately at right angles to said guide portion sheathing and can be inclined with respect to one another and with respect to the horizontal.

* * * * *